United States Patent [19]

Shimona et al.

[11] Patent Number: 5,034,652

[45] Date of Patent: Jul. 23, 1991

[54] ELECTRON GUN FOR COLOR-PICTURE TUBE

[75] Inventors: Taketoshi Shimona, Isesaki; Shinpei Koshigoe, Fukaya; Ryuichi Murai, Katano, all of Japan

[73] Assignee: Kabushiki Kaisha Toshiba, Kanagawa, Japan

[21] Appl. No.: 324,066

[22] Filed: Mar. 16, 1989

[30] Foreign Application Priority Data

Mar. 16, 1988 [JP] Japan ..... 63-62994

[51] Int. Cl.[5] ..... H01J 29/51

[52] U.S. Cl. ..... 313/414; 313/412; 313/460

[58] Field of Search ..... 313/412–414, 313/428, 458, 460

[56] References Cited

U.S. PATENT DOCUMENTS

| | | | |
|---|---|---|---|
| 3,970,890 | 7/1976 | Linssen | 313/413 |
| 4,086,513 | 4/1978 | Evans, Jr. | 313/414 |
| 4,678,964 | 7/1987 | Peels | 313/414 |

FOREIGN PATENT DOCUMENTS

| | | |
|---|---|---|
| 0104674 | 4/1984 | European Pat. Off. . |
| 0192436 | 8/1986 | European Pat. Off. . |
| 62-274533 | 11/1987 | Japan . |

OTHER PUBLICATIONS

European Search Report No. EP 89302624.5 dated Jul. 11, 1989.

Patent Abstracts of Japan, vol. 3, No. 36 (E-100), to Muranishi, Jan. 1979.

Patent Abstracts of Japan, vol. 12, No. 162 (E-609) (3009), to Naiki, Nov. 1987.

*Primary Examiner*—Donald J. Yusko

*Assistant Examiner*—Michael Horabik

*Attorney, Agent, or Firm*—Finnegan, Henderson, Farabow, Garrett and Dunner

[57] ABSTRACT

An electron gun for a color-picture tube includes adjacent low and high potential electrodes composing an electron lens, which electrodes have electron beam path holes horizonally formed with electric-field correcting members or raised portions. According to this construction, vertical equipotential lines are projected into the electrode so that the low potential electrode adds to electron beams a vertical focusing effect more strongly than a horizontal one and the high potential electrode adds to electron beams a vertical divergent effect more strongly than a horizontal one. The section of the electron beam in a deflection region has an ellipse shape whose major axis extends horizontally, resulting in suppressing a halo portion on the screen. The electron beam is properly focused horizontally and vertically so that the electron beam spot has a circular shape on the center of a screen. It results in improving the resolution on the periphery of the screen without having to lower the resolution on the center of the screen.

7 Claims, 10 Drawing Sheets

ELECTRON GUN FOR COLOR-PICTURE TUBE

FIELD OF THE INVENTION AND RELATED ART STATEMENT

The present invention relates to an electron gun used for a color-picture tube.

A typical electron gun for color-picture tube is an inline three electron beams type tube.

The inline three electron beams type tube comprises three cathodes disposed on grid plane, a first grid and a second one common to these cathodes, and a focusing electrode having two or more electrodes respectively with a plurality of holes and being disposed at given intervals in the axial direction of the tube. The three cathodes and the first and the second grids serve to generate three electron beams, and then the focusing electrode allows the three electron beams to pass through the holes for focusing these beams. The inline three electron beams type tube normally provides a deflection yoke, which generates an inhomogeneous magnetic field consisting of a pin-cushion type horizontally deflected magnetic field as shown in FIG. 1(*a*) and a barrel type vertically deflected magnetic field as shown in FIG. 1(*b*). The deflection yoke thus allows the three electron beams to self-converge on a fluorescent screen. In FIG. 1, B1, B2, and B3 respectively denote electron beams emitted from the inline electron gun. Curves show magnetic fields.

This type of self-convergence deflection system does not require an additional circuit for the convergence of the three electron beams, such as a dynamic convergence circuit. Thus, the system is less costly and allows easier convergence control. Hence, the color-picture tube employing the inline three electron beams type tube greatly contributes to the quality and performance of a color-picture tube.

The inhomogeneous magnetic field, however, brings about an adverse effect of lowering resolution on the peripheral part of the screen of the color-picture tube. The adverse effect is more distinguished as the deflection angle increases from 90° to 110°.

This effect results from the fact that the inhomogeneous magnetic field of the deflection yoke, as shown in FIGS. 1(*a*) and (*b*), weakens the horizontal focusing level of the electron beams and strengthens the vertical focusing level of the beams. As a result, a beam spot 1, which is located on the center of the screen, is substantially circular, but a beam spot 2, which is located on the pripheral part of the screen, is formed to have an elliptic high brightness core portion 3 extending horizontally and a low brightness halo portion 4 extending vertically.

This phenomenon will be directed with reference to FIGS. 3 and 4.

As shown in FIG. 3, the electron beam spot on the center of the screen is assumed to have a circular shape 5 as a result of being converged and diverged while the electron beams pass through a low potential region I and a high potential region II of a main lens. That is, a focusing angle $\alpha_2$ is assumed to allow the electron beams through a deflection region 6 to be substantially circular. As shown in FIG. 4, the electron beam 7 receives as a vertical force and the vertical force components 10 and 11 serve to over-focus the vertical components of an electron beam. After being deflected, therefore, the electron beam spot section is formed to have an ellipse 13 whose major axis extends horizontally and a halo 12.

To improve the deflection distortion described above, it is possible to employ a system having a pre-focusing lens for focusing an electron beam strongly and reducing a diameter of an electron beam passing through a main lens section and a deflected magnetic field. In the magnetic field, the vertical force components of the force subject to the electron beam at the deflecting time are made smaller so that the deflection distortion is reduced.

This system, however, must have an increased cross-over diameter so that the electron beam spot diameter on the center of the screen is made larger, resulting in lowering resolution on the center of the screen.

Another system for reducing the deflection distortion is a system providing an asymmetric pre-focusing lens or locating an asymmetric main lens for under-focusing the vertical components of the electron beam (the latter is disclosed in the U.S. Pat. No. 4,086,513).

Reference will be directed to the latter system. As shown in FIG. 5, the low potential region III and the high potential region IV of the main lens are respectively assumed to set the vertical divergence level (line segment A-B-C and a-b-c) to be stronger than the horizontal divergence level (line segment A-D-E and a-d-e). A vertical focusing angle $\alpha_1$ and a horizontal focusing angle $\alpha_2$ are assumed to allow the sectional form of the electron beam hit on the center of the screen to have an ellipse 14 whose major axis extends in the vertical direction. That is, the focusing angles allow the electron beam diameter in the deflection region 15 to have an ellipse 22 whose major axis extends horizontally and a halo 21, as shown in FIG. 6.

When the electron beam spot on the center of the screen is formed to have an ellipse whose major axis extends vertically, the vertical focusing angle $\alpha_1$ of the electron beam is smaller than focusing angle $\alpha_2$ when it is formed to have a substantial circle (as shown in FIGS. 3 and 4). Hence, the vertical force components 19 and 20 shown in FIG. 6 are made smaller than components 10 and 11 shown in FIG. 4. Thus the halo portion 21 is made smaller than the halo portion 12.

By assuming the vertical divergent effect to be larger than the horizontal divergent effect, therefore, it is possible to improve resolution on the peripheral part of the screen.

In the foregoing system, however, the electron beam spot on the center of the screen is formed to have an ellipse whose major axis extends vertically, which brings about a disadvantage that the resolution on the center of the screen is made lower.

The other system of providing an asymmetric main lens or an asymmetric pre-focusing lens also has the same disadvantage.

As set forth above, the self-convergence color-picture tube employing an inline type triple-gun greatly contributes the quality and performance of the color-picture tube, but it has a disadvantage that the resolution on the peripheral part of the screen is inferior and, for improving it, the resolution on the center of the screen is forced to be lower.

To further improve the picture quality given by the inline type triple-gun color-picture tube while keeping the disadvantages of the self-convergence system employing the above gun, accordingly, it is necessary to improve the resolution on the peripheral part of the screen without having to lower the resolution on the center of the screen.

OBJECT AND SUMMARY OF THE INVENTION

It is an object of the present invention to provide an electron gun for a color-picture tube which offers improved resolution onto the peripheral part of the screen without having to lower the resolution on the center of the screen and excellent resolution onto the overall screen.

It is another object of this invention to provide an electron gun for a color-picture tube which suppresses, or completely eliminates a halo portion generated on the peripheral part of the screen.

The electron gun for a color-picture tube according to this invention comprises a plurality of cathodes horizontally disposed to generate a plurality of electron beams at given intervals and a plurality of electrodes composing an electron lens for focusing the electron beams. The electron gun is characterized to add a relatively stronger vertical focusing effect than the horizontal focusing effect in the low potential electrode and a relatively stronger vertical divergent effect than the horizontal divergent effect in the high potential electrode.

The horizontal direction denotes the width of a surface containing an electron beam trajectory and the vertical direction denotes the normal of the surface.

For properly achieving the above focusing or divergent effect adding function, it is possible to form a vertical electric-field correcting member inside of the low potential electrode and the high potential electrode.

Several factors such as form, size, and position of an electric field correcting member may be variable depending on the size or deflection angle of a picture tube and the strength or form of a magnetic field caused by a deflection yoke.

The position for attaching the electric-field correcting member should be assumed so that the distance between the electric-field correcting members around the low potential electrode is larger than that between those members around the high potential electrode.

Moreover, by changing the form of electron beam path holes formed on the high potential electrode side of the low potential electrode or the low potential electrode side of the high potential electrode, it is possible to adjust the focusing effect and the divergent effect.

Preferably, a thin plate having a plurality of electron beam path holes should be attached on the high potential electrode side of the low potential electrode. This is preferable because it is possible to promote a lens effect of a small electron lens caused near each electron beam path hole as well as to control the main lens function by changing the form of each electron beam path hole formed on the thin plate.

For properly achieving the above focusing or divergent effect, it is also possible to vertically mount raised portions in the electron beam path holes formed on the high and low potential electrodes.

According to the invention, the electron gun for a color-picture tube has the electron beam path holes providing electric-field correcting members or raised portions, which members or raised portions are horizontally formed inside of the low potential electrode and the high potential electrode. The equipotential lines extending in the electrodes, therefore, serve to vertically offer the focusing effect around the low potential electrode or the divergent effect around the high potential electrode, so that both effects are stressed vertically.

The vertical size of an electron beam section in the deflection region is shorter than the horizontal size so that the sectional shape of the electron beam is a ellipse extending horizontally. The deflection distortion, therefore, is reduced, because the vertical components given by the horizontally deflected magnetic field within the inhomogeneous magnetic field reduced. The vertical focusing angle is smaller than the prior art so that the halo portion caused by the deflection may be suppressed.

The electron beams are properly focused on the fluorescent screen of the color-picture tube through the weak horizontal focusing and divergent effects and strong vertical focusing and divergent effects. The electron beam spot on the center of the screen is formed to be circular.

Consequently, without lowering the resolution on the center of the screen, the resolution on the peripheral part of the screen can be improved.

DETAILED DESCRIPTION OF PREFERRED EMBODIMENTS

Hereinafter, one embodiment of this invention will be described with reference to the drawings.

Figure 1A:
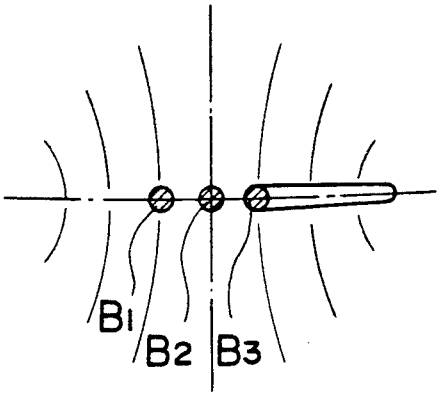
FIG. 1(*a*) is a view showing a pin cushion type magnetic field, and FIG. 1(*b*) is a view showing a barrel type magnetic field.
Figure 1B:
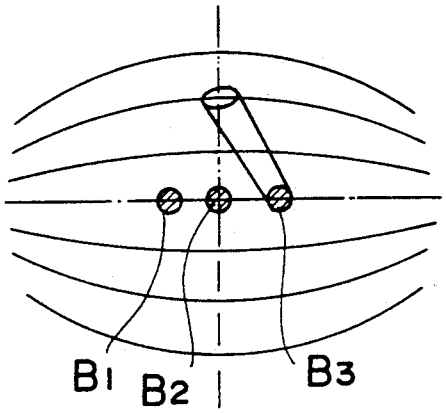
Figure 2:
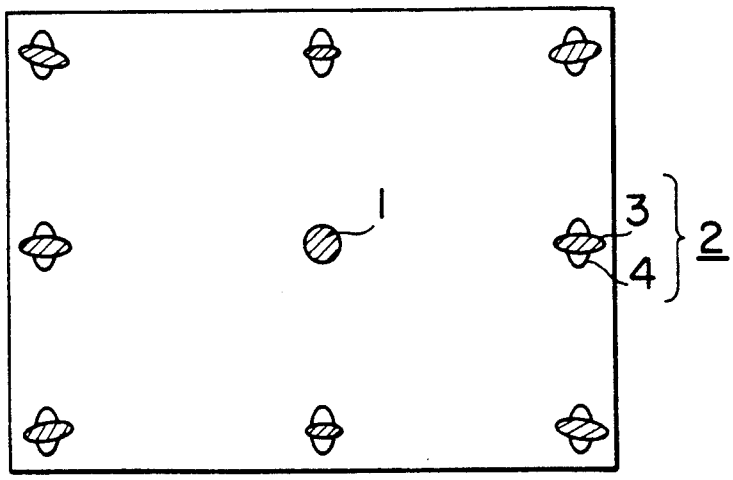
FIG. 2 PRIOR ART
FIG. 2 is a view showing forms of electron beam spots hit on the center and the peripheral part of the screen of the conventional color-picture tube.
Figure 3:
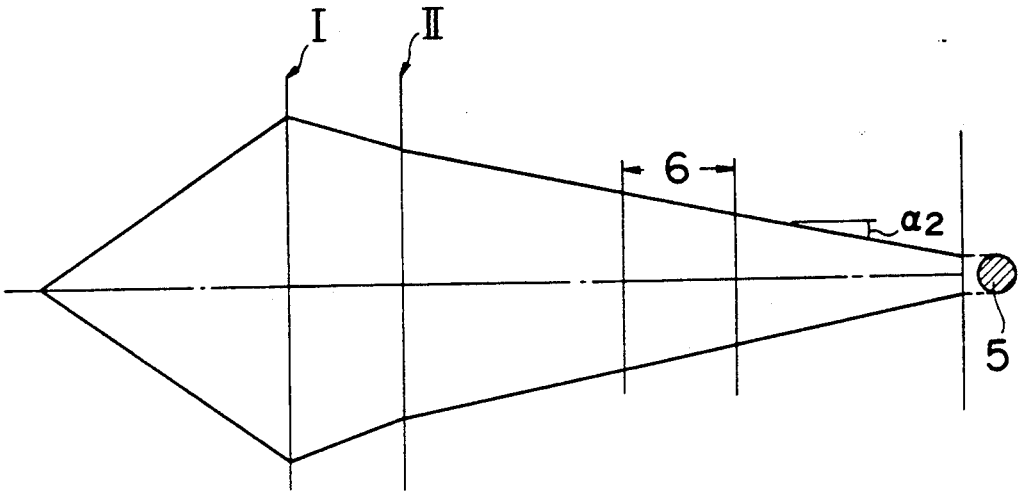
FIG. 3 PRIOR ART
FIG. 3 is a view showing the function of a conventional main lens.
Figure 4:
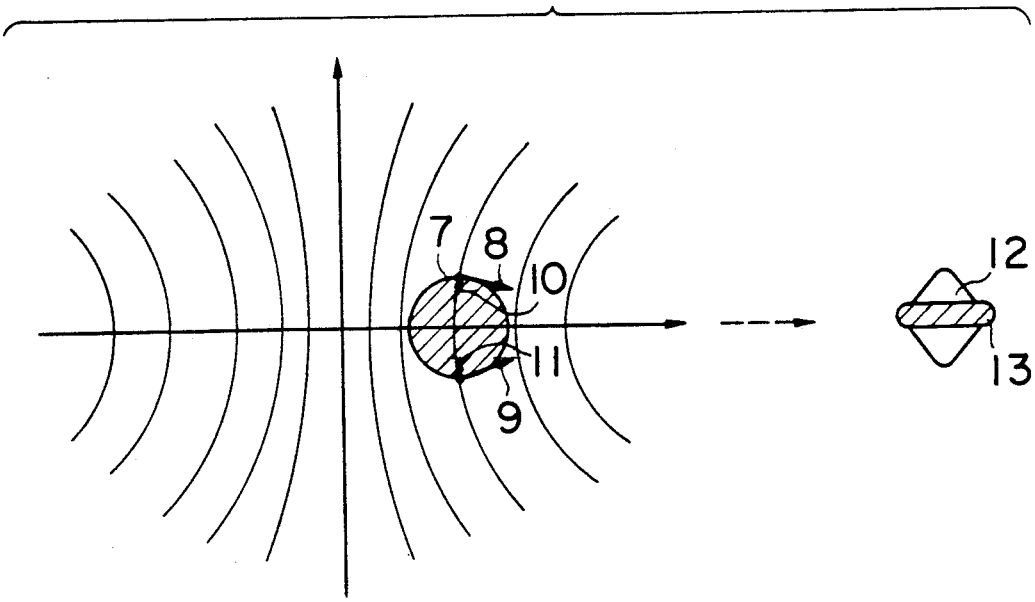
FIG. 4 PRIOR ART
FIG. 4 is an explanatory view for illustrating how a horizontally deflected magnetic field influences the electron beam focused by the main lens shown in FIG. 3.
Figure 5:
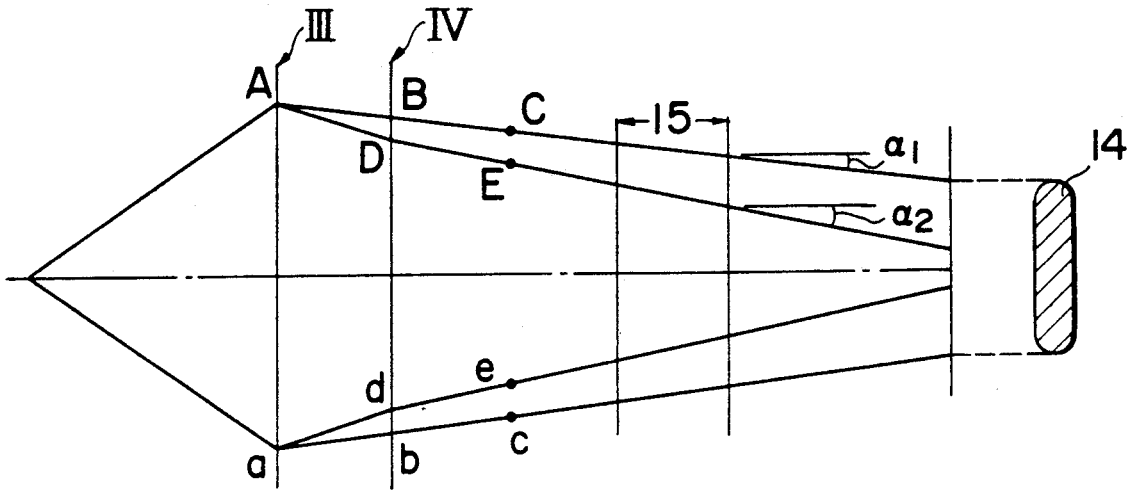
FIG. 5 PRIOR ART
FIG. 5 is a view showing the function of the other conventional main lens.
Figure 6:
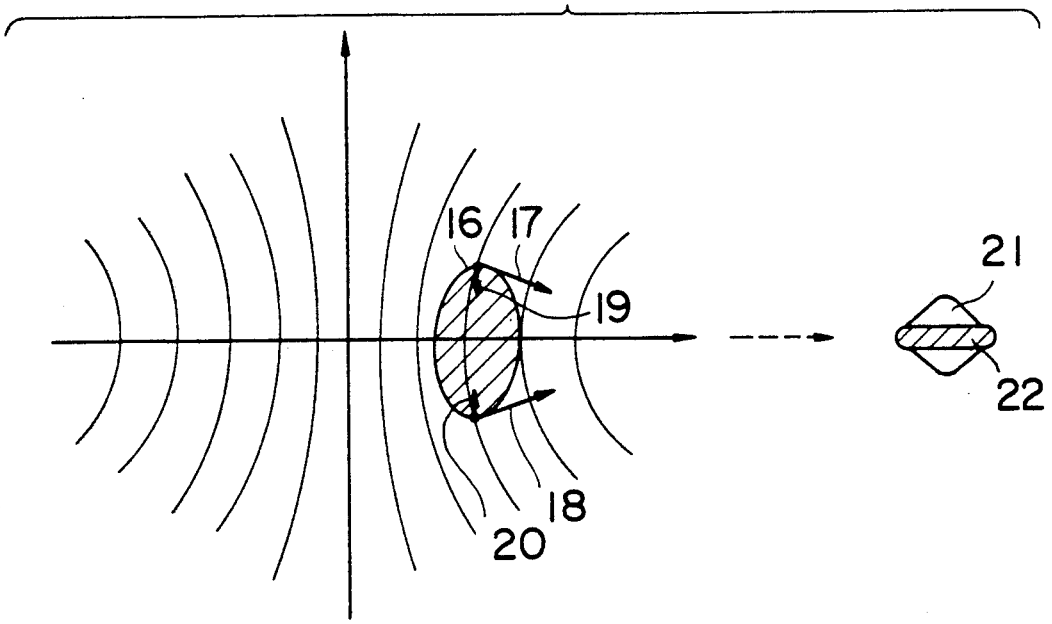
FIG. 6 PRIOR ART
FIG. 6 is an explanatory view for illustrating how the horizontally deflected magnetic field influences the electron beam focused by the main lens shown in FIG. 5.
Figure 7A:
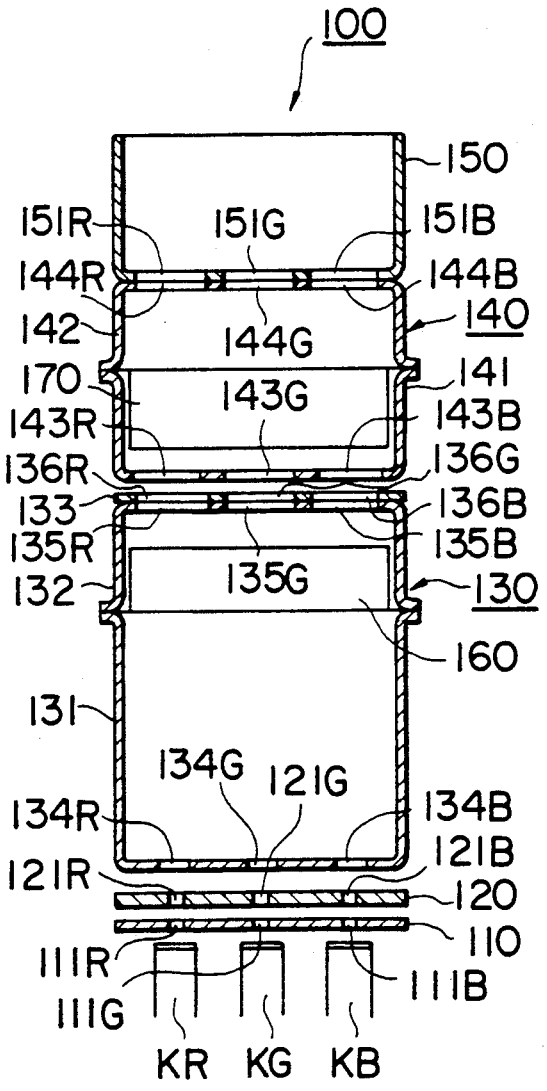
FIG. 7(*a*) is a schematic plan section showing one embodiment of an electron gun for a color-picture tube according to this invention, and FIG. 7(*b*) is a schematic vertical section showing an electron gun for a color-picture tube shown in FIG. 7(*a*)
Figure 7B:
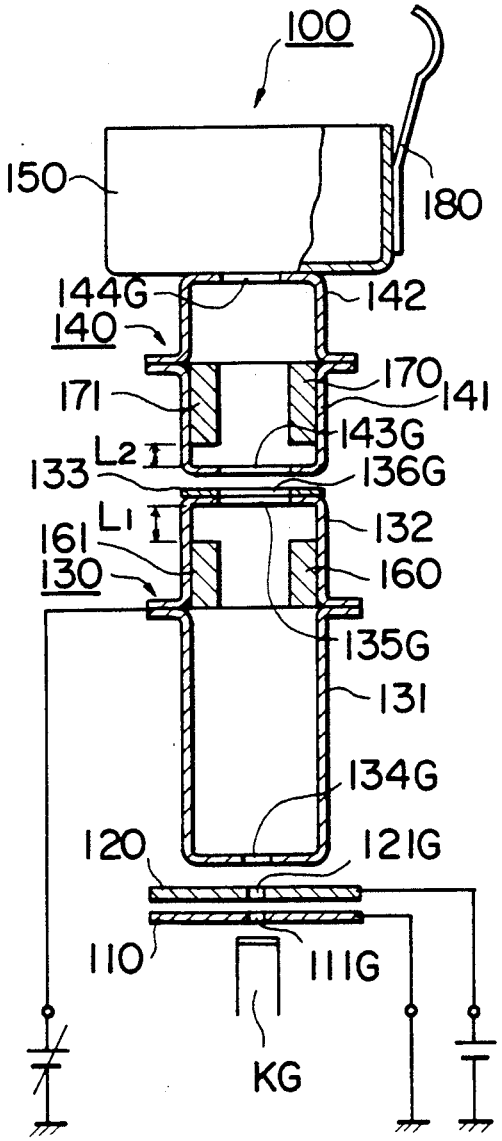

FIG. 7(*a*) is a schematic plan section showing one embodiment of an electron gun for color-picture tube according to the invention, and FIG. 7(*b*) is a schematic side section showing the above.

In FIG. 7(*a*) an electron gun 100 provides a heater (not shown) and comprises three cathodes KR, KG, and KB disposed in a line, a first electrode 110, a second electrode 120, a third electrode 130, a fourth electrode 140, and a convergence cup 150 disposed in the axial direction of the tube. The electron gun 100 is supported and secured by an insulating supporting rod (not shown).

The first electrode 110 is plate-like and its thickness is as thin as 0.2 mm. The electrode 110 includes three electron beam path holes 111R, 111G, and 111B formed therein. The diameter of the electrode 110 is as small as about 0.7 mm, and each distance between the centers of the holes is 6.6 mm.

The third electrode 130 consists of two cup-like electrodes 131 and 132 whose opening ends are mounted to each other, and a thin plate 133 which is about 0.6 mm.

On the second electrode 120 side of the cup-like electrode 131 are formed three electron beam path holes 134R, 134G, and 134B, each diameter of which is 1.3 mm.

The fourth electrode 140 side of the cup-like electrode 132 is substantially tubular with no burring portion. On this side are formed three substantially circular electron beam path holes 135R, 135G, and 135B, the maximum diameter of which is 6.2 mm.

On the thin plate 133 are formed three substantially circular electron beam path holes 136R, 136G, and 136B, which are identical to the electron beam path holes 135R, 135G, and 135B of the cup-like electrode 132.

On the inner wall of the cup-like electrode 132 are formed electric-field correcting members 160 and 161 respectively consisting of tubular plates whose thickness is about 1.2 mm, length is about 3.0 mm, and width is 19.0 mm. The electric-field correcting members 160 and 161 are located in a horizontal manner to a trajectory surface of each electron beam and as if they pinch the trajectory surface. These members keep an axial distance ($L_1$) of 3.0 mm from the surface containing the electron beam path holes 135R, 135G, and 135B.

A fourth electrode 140 consists of two cup-like electrodes 141 and 142 whose opening ends are closely mounted to each other.

The third electrode 130 side of the cup-like electrode 141 is substantially tabular with no burring portion. On this fourth electrode 141 are formed substantially circular electron beam path holes 143R, 143G, and 143B which are similar to the electron beam path holes 135R, 135G, and 135B of the cup-like electrode 132.

On the inner wall of the cup-like electrode 141 are formed electric-field correcting members 170 and 171 respectively consisting of tabular plates whose thickness is about 1.5 mm, length is about 3.0 mm, and width is 19.0 mm. The electric field correcting members 170 and 171 are located in a horizontal manner to a trajectory surface of each electron beam and as if they pinch the trajectory surface. These members keep an axial distance ($L_1$) of 2.0 mm from the surface containing the electron beam path holes 143R, 143G, and 143B.

On the convergence cup 150 side of the cup-like electrode 142 are formed three substantially circular electron beam path holes 144R, 144G, and 144B, respectively, with large diameters. The convergence cup 150 is in contact with these holes.

On the cup-like electrode 142 side of the convergence cup 150 are formed substantially circular electron beam path holes 151R, 151G, and 151B, respectively, with large diameters. A spring 180 is fixed to the lower portion of the convergence cup 150. It is applied on a conductive film (not shown) coated on the neck inner wall.

A d.c. voltage of about 150 V and a modulation signal corresponding to a screen are applied on the cathodes KR, KG, and KB of the electron gun 100. A first electrode 110 is grounded and a second electrode 120 is about 600 V. A voltage of about 7 kV is applied to a third electrode 130 and a high voltage of about 25 kV is applied to a fourth electrode 140 through the conductive film, the spring 180, and the convergence cup 150.

The cathodes KR, KG, KB, the first electrode 110, and the second electrode 120 compose a triode, which serves to emit an electron beam and form a crossover.

The interval between the second electrode 120 and the third electrode 130 composes a pre-focusing lens for preliminarily focusing an electron beam emitted from the triode.

The interval between the third electrode 130 and the fourth electrode 140 composes a main lens for finally focusing electron beams on the fluorescent screen.

The main lens affords a focusing effect on the third electrode 130 side the relatively low voltage is applied and a divergent effect on the fourth electrode 140 side the relatively high voltage is applied. Since the electron beam is greatly influenced by the low voltage side effect, at the last stage, the electron beam is focused on the fluorescent screen.

The electric field correcting plates 160, 161, 170, and 171 are provided inside of the third electrode 130 and the fourth electrode 140, so that the horizontal curvature for electric field penetration is different from the vertical one near the electron beam path holes 135R, 135G, 135B, 136R, 136G, 136B, 143R, 143G, and 143B.

Figure 8A:
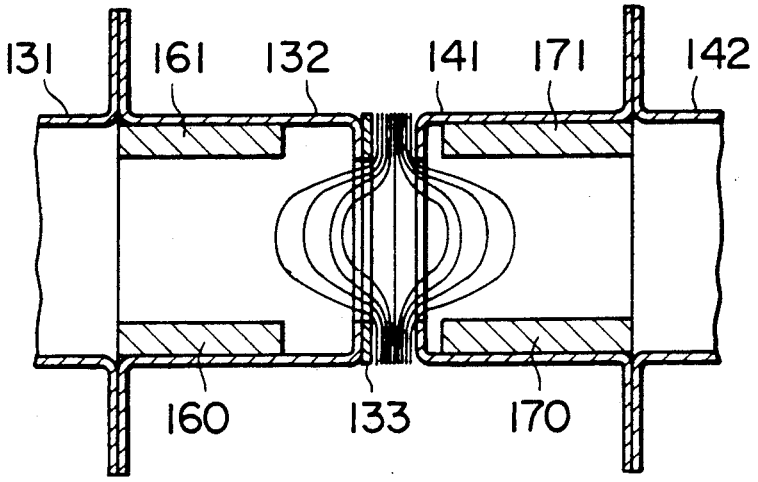
FIG. 8(*a*) is a vertical section showing equipotential distribution around main lens, and FIG. 8(*b*) is a horizontal section showing equipotential distribution around the main lens.
Figure 8B:
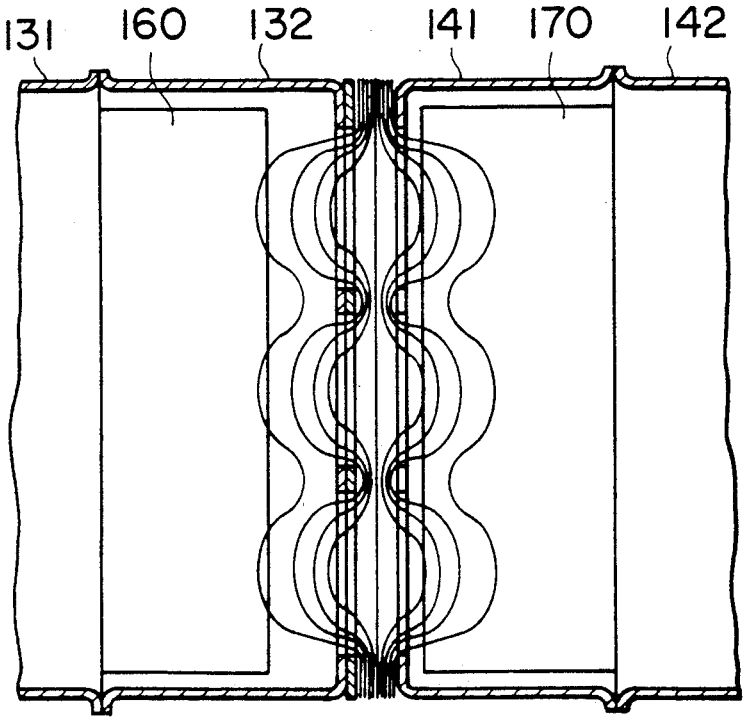

Herein, the equipotential distribution near the main lens will be described with reference to FIG. 8. FIG. 8(*a*) is a vertical section showing the equipotential distribution near the main lens, and FIG. 8(*b*) is a horizontal section showing the above.

As shown in FIG. 8(*a*), the vertical equipotential distribution located inside of the cup-like electrodes 132 and 141 is designed so that the central portions of the equipotential lines are projected within the electrode through the effect of the electric-field correcting members 160, 161, 170, and 171. This effect is very large in the cup-like electrode 141 where the distance between the electric-field correcting members is short.

As shown in FIG. 8(*b*), on the other hand, the horizontal equipotential distribution is designed so that no equipotential lines are projected a shown in FIG. 8(*a*) because of the absence of the horizontal electric field correcting plates.

The vertical curvature of the equipotential lines is designed to be larger than the horizontal curvature.

In other words, the vertical focusing and divergent effects are relatively stronger, and the horizontal focusing and divergent effects are relatively weaker.

Figure 9:
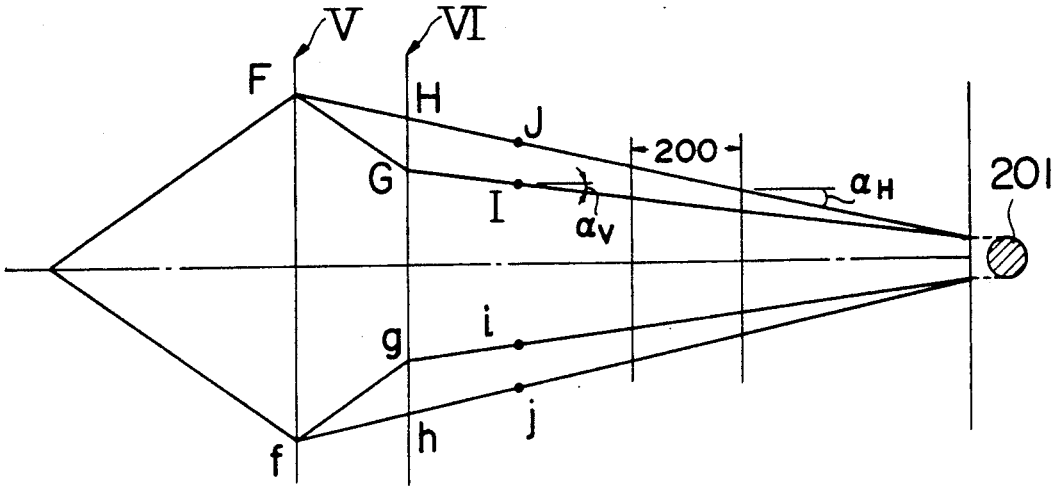
FIG. 9 is a view for illustrating the function of the main lens.
Figure 10:
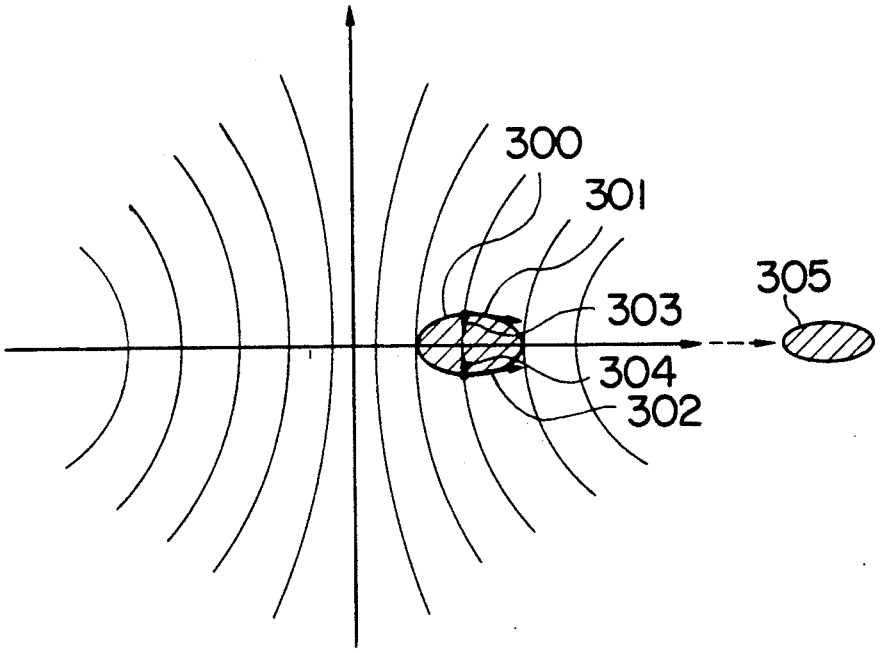
FIG. 10 is an explanatory view for illustrating how the horizontally deflected magnetic field influences an electron beam focused by the main lens shown in FIG. 9.

FIGS. 9 and 10 conceptually show the function of the main lens.

In FIG. 9, the electron beam is shown by a real line. When the electron beam passes through the third electrode area V, the vertical focusing effect has a stronger influence over the electron beam as shown in lines F-G and f-g, and the horizontal focusing effect has a weaker influence over it as shown in lines F-H and f-h. In the fourth electrode area, VI of the main lens, the vertical divergent effect has a stronger influence over the electron beam as shown in lines G-I and g-i, and the horizontal divergent effect has a weaker influence over it as shown in lines H-J and h-j.

As set forth above, the main lens affords respective functions to the electron beam according to the vertical or horizontal direction. $\alpha v$ is a focusing angle in the vertical direction, and $\alpha H$ is a focusing angle in the horizontal direction. The sectional shape of the electron beam in the deflection region 200 has a smaller vertical diameter than the horizontal one. That is, the electron beam has an elliptic shape in section 200, the major axis of which extends horizontally. The electron beam spot shape 201 is substantially circular.

As shown in FIG. 10, since the electron beam 300 receives small vertical components 303 and 304 of the influences 301 and 302 afforded b the horizontally deflected magnetic field when it is deflected, the deflected beam is hardly distorted. And, the focusing angle $\alpha v$ in the vertical direction is small. Hence, the electron beam spot shape deflected on the peripheral part of the screen has an ellipse 305 and a suppressed halo portion, the major axis of which ellipse extends horizontally.

Figure 11:
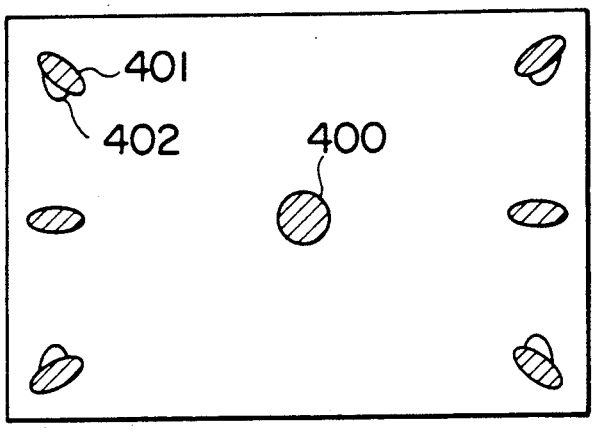
FIG. 11 is a view showing the form of an electron beam spots on the center and the peripheral part of the screen of the color-picture tube.

In FIG. 11, the central electron beam spot 400 has a substantially circular shape, and the peripheral part electron beam spot 401 has an elliptic shape with a suppressed or no halo portion. Thus the resolution on the peripheral part of the screen can be improved without having to lower the resolution on the center of the screen.

Figure 12A:
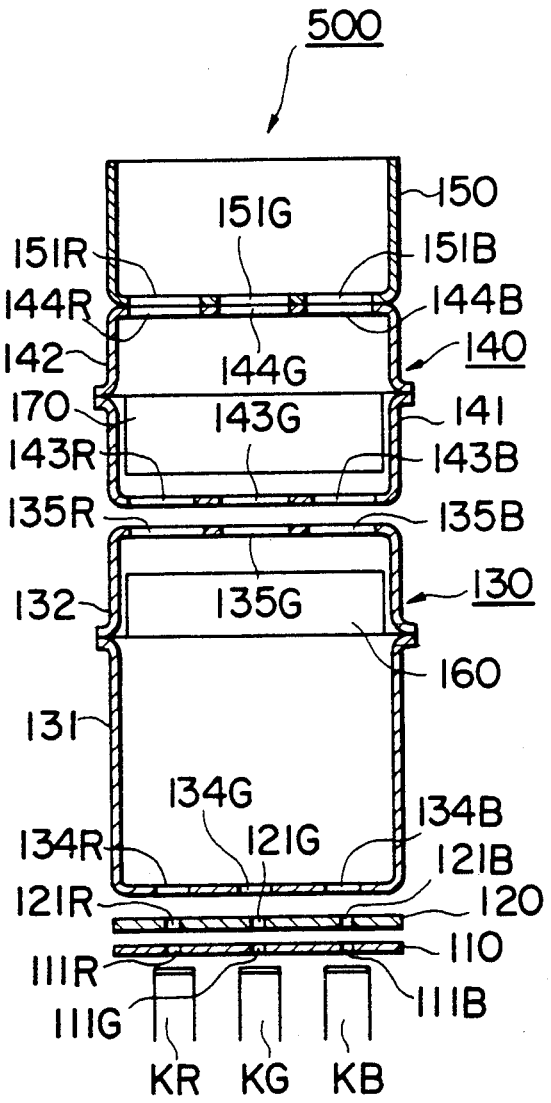
FIG. 12(*a*) is a schematic horizontal view showing the other embodiment of an electron gun for color-picture tube according to the invention, and FIG. 12(*b*) is a schematic vertical section showing the electron gun shown in FIG. 12(*a*)
Figure 12B:
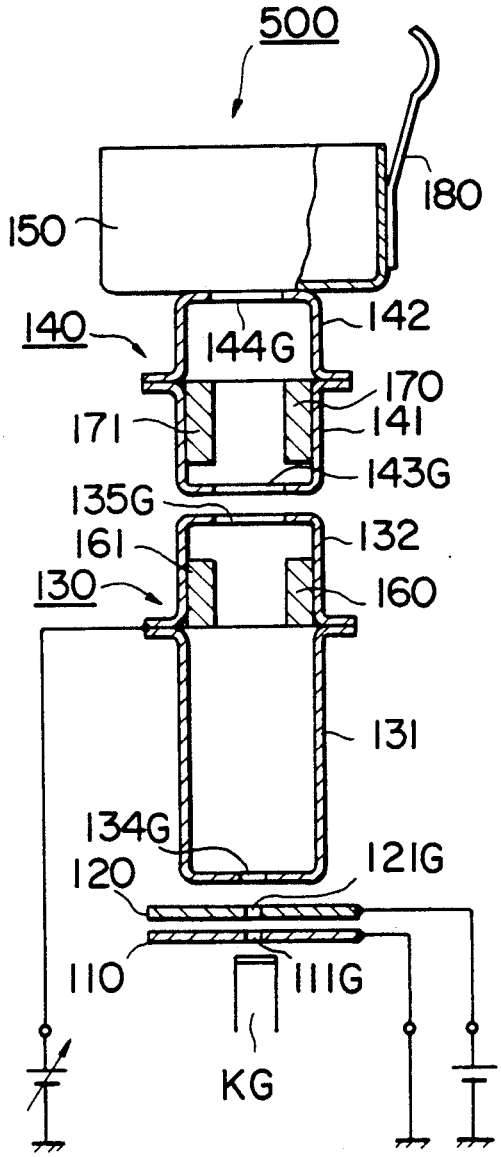

FIG. 12 shows another embodiment of an electron gun for a color-picture tube according to this invention. FIG. 12(*a*) is a schematic plan section showing the embodiment, and FIG. 12(*b*) is a schematic side section showing it.

An electron gun shown in FIG. 12 is identical to the electron gun 100 shown in FIG. 7 except that the thin plate 133 is removed. When employing the electron gun 500, it is possible to obtain the similar effect as when using the electron gun 100. In FIG. 12, like reference numbers are given to the members common to those shown in FIG. 7.

Figure 13:
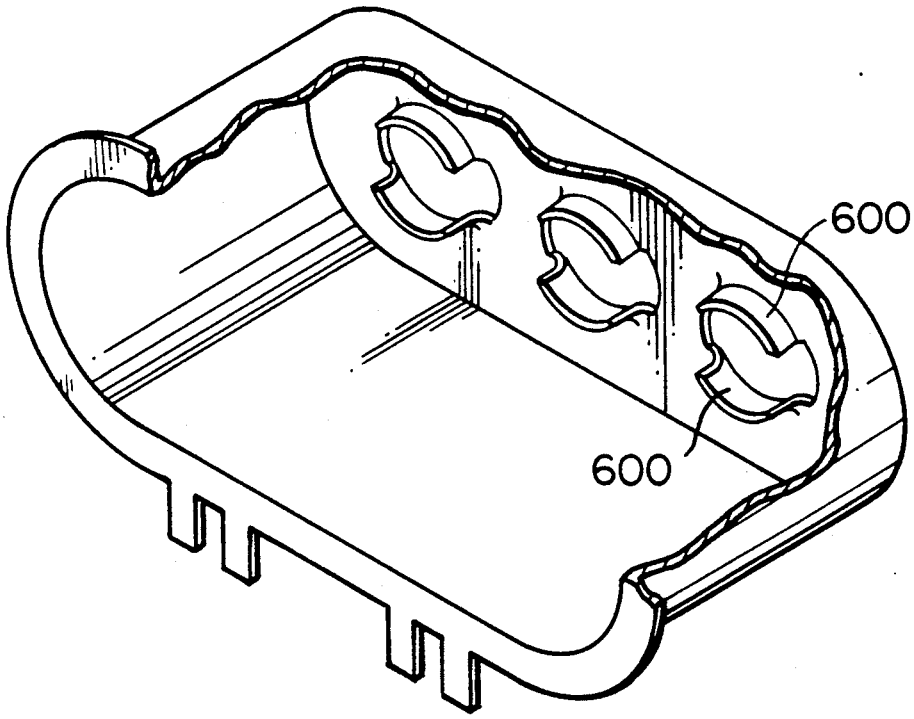
FIG. 13 is a perspective view showing a burring portion employed for the electron gun for color-picture tube according to the invention.

In place of the electric-field correcting members 160, 161, 170, and 171 shown in FIGS. 7 and 12, it is possible to locate bent portions 600 which are bent in a direction orthogonal to the disposition of three electron beam path holes so as to insert the electron beam inside of the low potential electrode face opposite to the high potential electrode and the high potential electrode face opposite to the low potential electrode, both the faces composing the main lens, for the purpose of obtaining similar effect as in case of using the electric-field correcting members, as shown in FIG. 13.

The shape of an electron beam spot is variable depending on the size or deflection angle of a color-picture tube or the strength, shape or change rate of a deflection field. For optimizing the function of an asymmetric lens, it is necessary to set variable parameters such as the form, length, or mounting position of a electric-field correcting member or the shape of each electron beam path hole.

Figure 14:
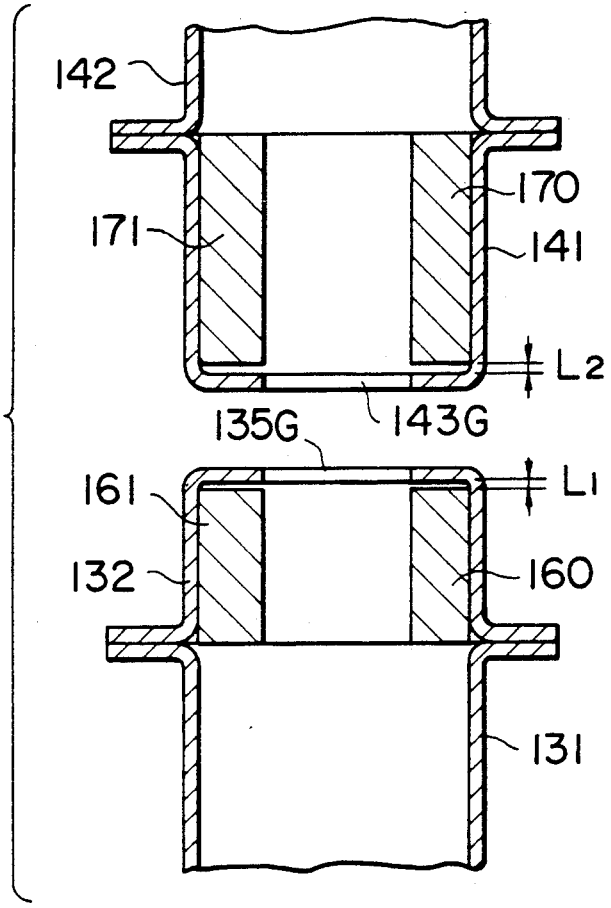
FIG. 14 is a view showing the position of mounting an electric-field correcting member employed for the electron gun for a color-picture tube according to the invention.

If the deflection yoke generates a stronger magnetic field than that in the foregoing embodiment, for optimizing the function of the asymmetric lens, it is possible to assume the distances $L_1$ and $L_2$ between the electric-field correcting members 160, 161, 170, and 171 and the electron beam path holes 135G and 143G as being smaller than those in the foregoing embodiment or to assume $L_1=0$ and $L_2=0$, as shown in FIG. 14 wherein the electron gun 500 shown in FIG. 12 is employed.

In FIG. 14, the members common to those in FIG. 12 have similar reference numbers as those in FIG. 12.

As an optimizing method, there exist the following methods.

Figure 15:
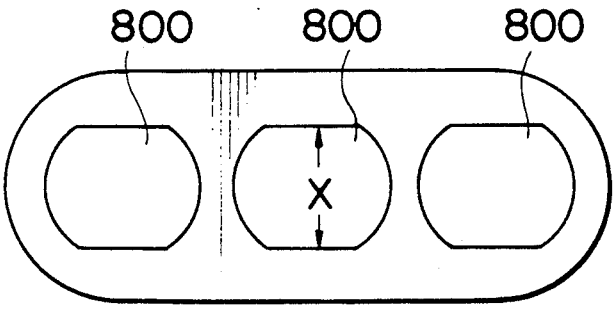
FIG. 15 is a view showing example forms of electron beam path holes employed for a the electron gun for color-picture tube according to the invention.

(1) At least one group of electron beam path holes is selected out of the electron beam path holes formed on the electron lens side of the low potential electrode or the thin plate closely located on the low potential electrode side and those holes formed on the electron lens side of the high potential electrode, and the selected electron beam path holes respectively should have oval forms with the height X of each hole being set as a parameter, as shown in FIG. 15.

(2) The method described in (1) should be combined with the conditions of the distances $L_1$ and $L_2$ between the foregoing electric-field correcting members and the electron beam path holes.

Figure 16:
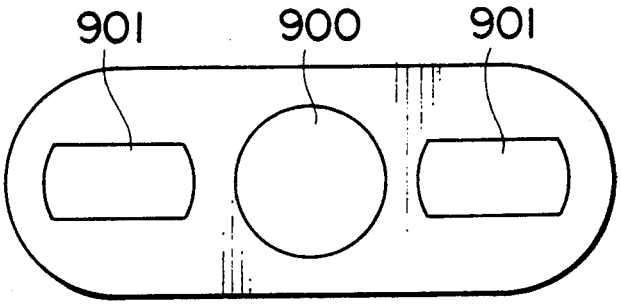
FIG. 16 is a view showing the other example forms of electron beam path holes employed for the electron gun for color-picture tube according to the invention.

Furthermore, for optimizing the form of a central beam and a side beam using the above (1) and (2) methods, there exist the following methods;

First, at least one group of electron lens path holes are selected out of the electron beam path holes formed on the electron beams side of the low potential electrode or the thin plate closely located on the low potential electrode side or those holes formed on the electron lens side of the high potential electrode, and the openings of the selected group of electron beams path holes should consist of the combination of circular openings 900 and oval ones 901 as shown in FIG. 16.

Figure 17:
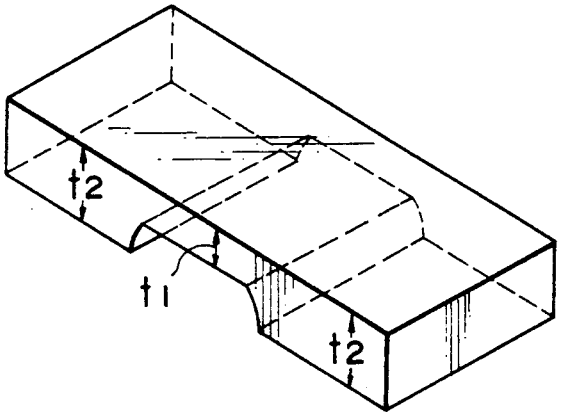
FIG. 17 is a perspective view showing an example form of the electric-field correcting member employed for the electron gun for a color-picture tube according to the invention.
Figure 18:
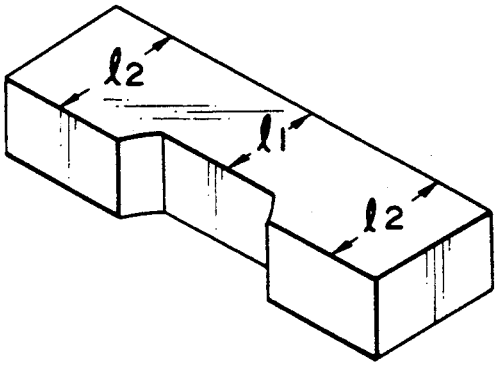
FIG. 18 is a perspective view showing the other example form of the electric-field correcting member employed for the electron gun for a color-picture tube according to the invention.

Second, it is possible to employ the method of varying the thickness $t_1$ of the center beam portion on the electric-field correcting member and the thickness $t_2$ of the side beam portion thereof, as shown in FIG. 17.

Third, it is also possible to employ the method of varying the length $l_1$ of the center beam portion of the electric-field correcting member and the length $l_2$ of the side beam portion thereof.

The foregoing methods allow the function of the orthogonal asymmetric lens to be optimized, thus making it possible to achieve excellent resolution over the whole screen of the color-picture tube.

Although the embodiments of this invention have been described with reference to a bi-potential type electron gun, the function and the effect of this invention may be applied to another type electron gun such as a uni-potential type electron gun or quadru-potential type electron gun.

What is claimed is:

1. An electron gun for a color-picture tube, comprising:

an inline type electron beam generating region including a plurality of cathodes disposed horizontally for generating a plurality of electron beams;

a main lens for focusing the plurality of electron beams onto a screen, and for producing horizontal focusing, vertical focusing and divergent effects, the main lens being between at least one low voltage electrode and one high voltage electrode; and the at least one low voltage electrode and high voltage electrode each including:

two cup-like parts each having an open end and a bottom plate, the two cup-like parts being mounted together at the open end, and each of the bottom plates having electron beam path holes through which the electron beams pass, and an electric field correcting member on each side of both the low voltage electrode and the high voltage electrode and parallel to the electron beams for stronger vertical focusing and divergent effects than horizontal focusing and divergent effects at the main lens;

the at least one low voltage electrode and high voltage electrode being opposite to each other at adjacent bottom plates of the respective two cup-like parts.

2. The electron gun of claim 1, wherein the low voltage electrode further includes a thin plate adjacent to the bottom plate of the low voltage electrode and the bottom plate of the high voltage electrode.

3. The electron gun of claim 1, wherein at least one group of the electron beam path holes comprises a central electron beam path hole and side electron beam path holes located on both sides of the central electron beam path hole, a ratio of vertical diameter to horizontal diameter of the central electron beam path holes and the side electron beam path holes being different.

4. The electron gun of claim 3, wherein the distance between the central electron beam path and the electric field correcting members of at least one of the low voltage and high voltage electrodes is different from the distance between the side electron beam path and the electric field correcting members of the same electrode.

5. The electron gun of claim 4, wherein the distance between the central electron beam path and the electric field correcting members of at least one of the low voltage and high voltage electrodes is larger than the distance between the side electron beam path and the electric field correcting members of the same electrode.

6. The electron gun of claim 1, wherein the bottom plate includes a surface having a center beam portion and a side beam portion, and the distance in an axial direction of the color-picture tube between the electric field correcting members of at least one of the low voltage and high voltage electrodes and the center beam portion of the surface of the bottom plate is different from the distance in an axial direction of the color-picture tube between the electric field correcting members of at least one of the low voltage and high voltage electrodes and the side beam portion of the surface of the bottom plate.

7. The electron gun of claim 1, wherein each electric field correcting member includes a peripheral portion on an opposite side of each of the electron beam path holes, the peripheral portion being bent from the periphery of the electron beam path holes toward the electrodes in a direction orthogonal to the disposition of the electron beam path holes, the electron beams passing through the bent portions.

* * * * *

UNITED STATES PATENT AND TRADEMARK OFFICE

CERTIFICATE OF CORRECTION

PATENT NO. : 5,034,652

DATED : July 23, 1991

INVENTOR(S) : Taketoshi Shimoma et al.

It is certified that error appears in the above-identified patent and that said Letters Patent is hereby corrected as shown below:

On the title page, Items [75] and [19]:

Inventors, change "Taketoshi Shimona" to --Taketoshi Shimoma--.

Abstract, line 4, change "horizonally" to --horizontally--.

Signed and Sealed this

Sixth Day of April, 1993

*Attest:*

STEPHEN G. KUNIN

*Attesting Officer*

*Acting Commissioner of Patents and Trademarks*